United States Patent [19]

Azeta et al.

[11] Patent Number: 4,953,846

[45] Date of Patent: Sep. 4, 1990

[54] APPARATUS FOR CONVEYING A SHEET OBLIQUELY

[75] Inventors: Takahiro Azeta, Kawasaki; Toru Kameyama, Tokyo; Harukazu Sekiya, Yokohama; Toshifumi Moritani, Yokohama; Akira Higeta, Yokohama; Kenji Baba, Kofu; Takeshi Matoba, Yokohama; Shinji Goto, Tokyo; Kazuyuki Kubota, Yamanashi, all of Japan

[73] Assignees: Canon Kabushiki Kaisha; Nippon Seimitsu Kogyo Kabushiki Kaisha, Tokyo, Japan

[21] Appl. No.: 233,485

[22] Filed: Aug. 17, 1988

[30] Foreign Application Priority Data

Aug. 19, 1987 [JP] Japan ..... 62-206648
Aug. 19, 1987 [JP] Japan ..... 62-126686[U]

[51] Int. Cl.[5] ..... B65H 9/16
[52] U.S. Cl. ..... 271/251; 271/902
[58] Field of Search ..... 271/251, 902

[56] References Cited

U.S. PATENT DOCUMENTS 4,486,014 12/1984 Enoguchi ..... 271/251 X
4,775,143 10/1988 Arnoldi ..... 271/251

OTHER PUBLICATIONS

IBM Technical Disclosure Bulletin, vol. 15, No. 4, pp. 1253, Sep. 1972, "Paper Feed Aligner Mechanism", G. D. Anderson.

*Primary Examiner*—Richard A. Schacher
*Attorney, Agent, or Firm*—Fitzpatrick, Cella, Harper & Scinto

[57] ABSTRACT

A sheet obliquely conveying apparatus is provided with a pair of sheet conveying rollers including a forwardly and reversely rotatable drive roller and a follower roller rotatable in contact with the drive roller, and bearing structure for rotatably supporting the shaft of the follower roller. The dimension of the bearing portion of the bearing structure which supports one end of the shaft of the follower roller is greater generally along the direction of conveyance of a sheet material than the dimension of the bearing portion of the bearing structure which supports the other end of the shaft of the follower roller. The apparatus is further provided with a resilient device generally parallel to the direction of conveyance of the sheet material for pressing the shaft of the follower roller.

10 Claims, 8 Drawing Sheets

APPARATUS FOR CONVEYING A SHEET OBLIQUELY

BACKGROUND OF THE INVENTION

1. Field of the Invention

This invention relates to an apparatus for sheet or paper conveyance in an image recording apparatus, and more particularly to a sheet obliquely conveying apparatus for conveying paper obliquely.

2. Related Background Art

The structure for sheet conveyance in an image recording apparatus according to the prior art will hereinafter be described with reference to the accompanying drawings.

FIG. 1 is a perspective view of a paper conveying portion.

In FIG. 1, the reference numeral 1 designates a roller, the reference numeral 2 denotes the rotary center shaft of the roller 1, the reference numerals 3 and 3' designate bearing members supporting the shaft 2, and the reference numeral 4 denotes a cylindrical drive roller which is in contact with the roller 1 and to which rotation is transmitted by a belt or the like.

The width $l_1$ of the restricting end of the bearing member 3 is somewhat greater than the width $l_2$ of the restricting end of the bearing member 3' in the tangential direction of the point of contact between the roller 1 and the drive roller 4. The restricting ends 301 and 303 of the bearing members 3 and 3', respectively, are parallel to the rotary center shaft of the drive roller 4 and lie on the same or common straight line.

FIG. 2 is a side view of the sheet conveying portion as a sheet passes therethrough.

The sheet conveying operation will now be described.

As the drive roller 4 is rotated in the direction of solid-line arrow, the roller 1 is also rotated. When the sheet 5 comes into the nip between the roller 1 and the drive roller 4, the sheet is conveyed by the rotation of the drive roller 4. When the sheet 5 is being conveyed, the roller 1 is also rotated and drawn in the tangential direction of the point of contact between it and the sheet 5 due to the friction between the roller 1 and the paper 5.

FIG. 3 is a top plan view of the paper conveying portion when the sheet 5 is conveyed in the direction from A to B. In FIG. 3, the reference numerals 301–304 designate restricting ends. The restricting ends 301 and 303 are parallel to the rotary center shaft of the drive roller 4, and the dot-and-dash line indicates that these restricting ends are on the same straight line.

In FIG. 3, when the sheet 5 is conveyed, the roller 1 is also drawn and the opposite ends of the shaft 2 come into contact with the restricting ends 301 and 302, and therefore, the direction of the rotary shaft of the roller 1 becomes parallel to the direction of the rotary shaft of the drive roller 4, and the paper is conveyed in a direction perpendicular to the rotary shaft of the drive roller 4.

Turning back to FIG. 2, when the drive roller 4 is rotated reversely in the direction of broken-line arrow, the sheet 5 is conveyed reversely and the roller 1 is likewise rotated reversely due to the friction and is drawn in the opposite direction.

FIG. 4 is a top plan view of the sheet conveying portion when the paper is conveyed in the direction from B to D. In FIG. 4, the reference numerals 1–5 and 301–304 designate elements identical those in FIG. 3.

The drive roller is rotated reversely and the sheet 5 is conveyed reversely, whereby the roller 1 is drawn and the shaft 2 comes into contact with the restricting ends 302 and 304 of the bearing members and becomes inclined by an amount corresponding to the gap (about $(l_1-l_2)$) and the sheet 5 is conveyed obliquely.

However, in the above-described example of the prior art, the follower roller 1 holds down the sheet 5 by only its gravity and therefore, a slip is liable to occur between the sheet 5 and the roller 1, and this has led to the disadvantage that the sheet cannot be reliably conveyed obliquely.

SUMMARY OF THE INVENTION

The present invention has been made in view of what has been described above, and the object thereof is to provide a sheet obliquely conveying apparatus which can ensure conveyance of a sheet material, and more particularly, oblique conveyance of a sheet material.

According to the present invention, the rotary center shaft of a rotatable roller adjacent to a drive roller is pressed by a leaf spring or the like and the roller is thereby urged against the drive roller to increase the conveying force and thereby ensure that the sheet is reliably conveyed obliquely.

As described above, a spring force is caused to act on the rotary shaft of the rotatable member parallel to the direction of sheet conveyance, whereby the sheet can be simply and reliable conveyed obliquely in only one direction.

DESCRIPTION OF THE PREFERRED EMBODIMENTS

Figure 1:
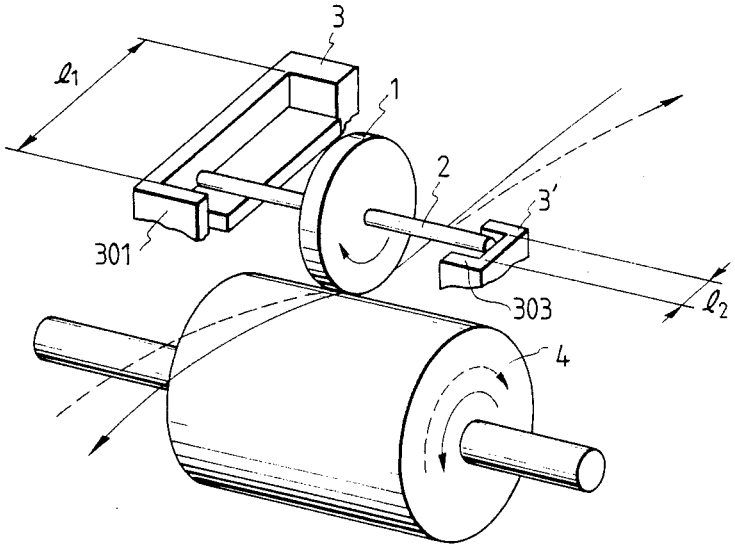
FIG. 1 PRIOR ART
FIG. 1 is a perspective view of a sheet conveying portion according to the prior art.
Figure 2:
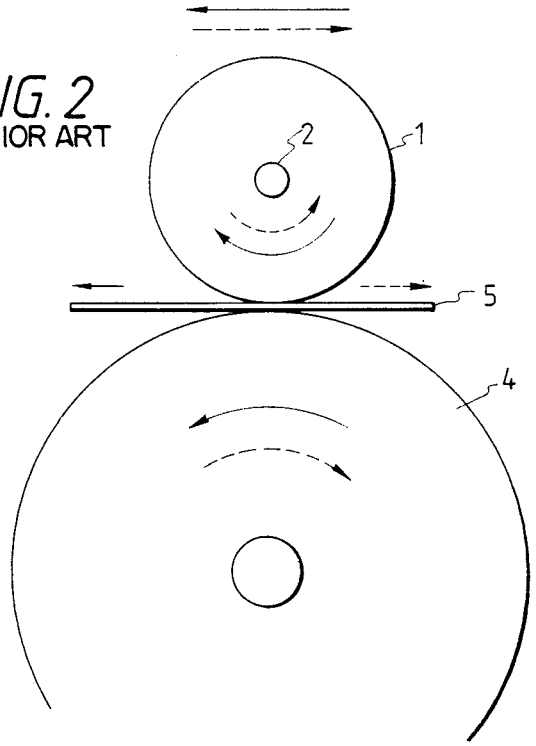
FIG. 2 PRIOR ART
FIG. 2 is a side view of the sheet conveying portion according to the prior art.
Figure 3:
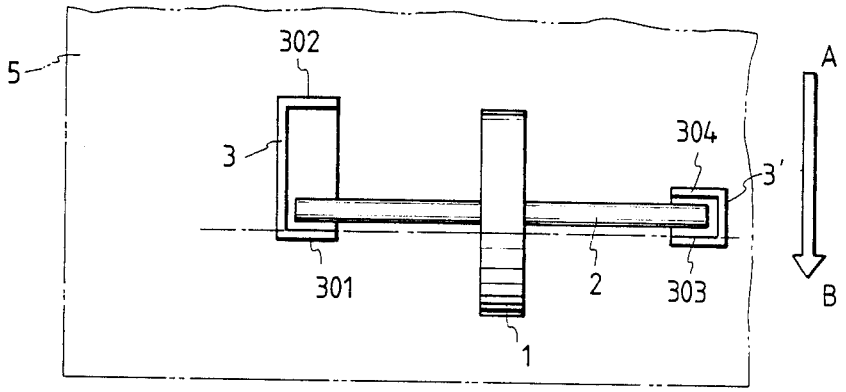
FIG. 3 PRIOR ART
FIG. 3 is a top plan view of the sheet conveying portion according to the prior art when the roller is rotated forwardly.
Figure 4:
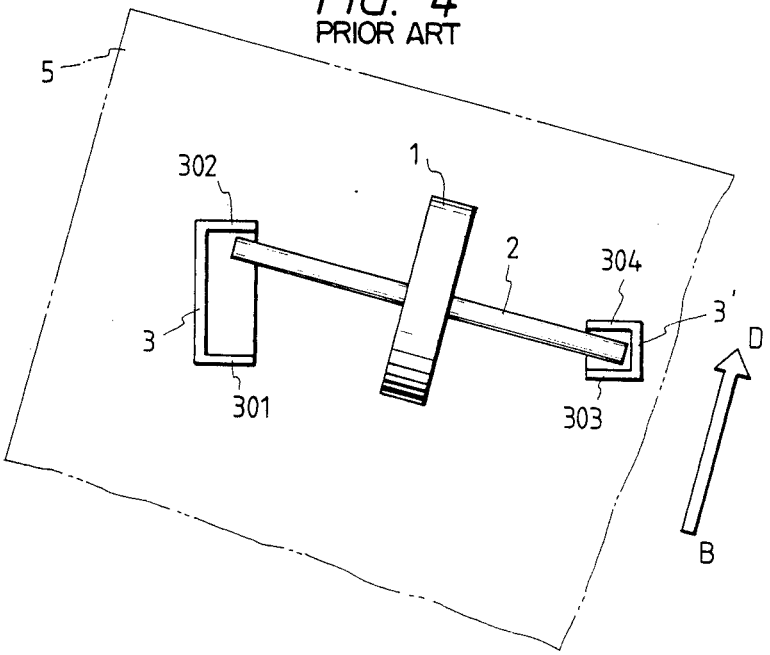
FIG. 4 PRIOR ART
FIG. 4 is a top plan view of the sheet conveying portion according to the prior art when the roller is rotated reversely.
Figure 5:
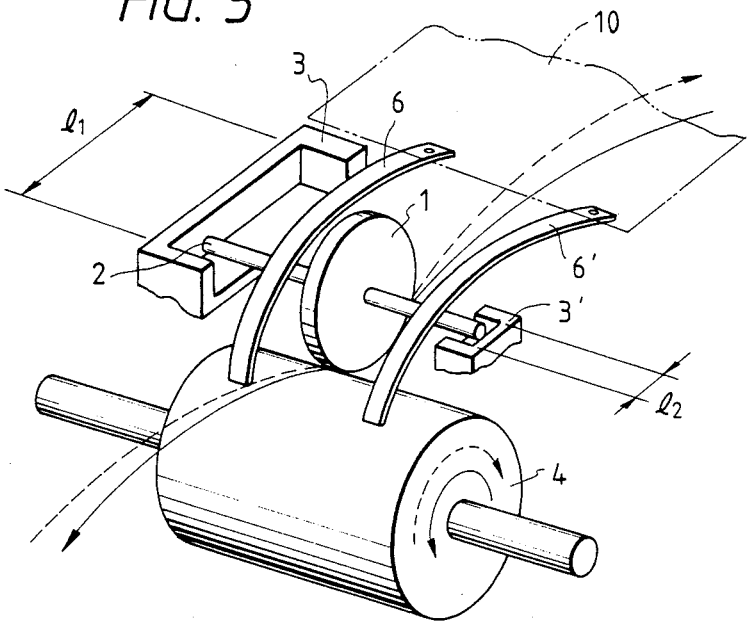
FIG. 5 is a perspective view of a sheet obliquely conveying apparatus embodying the present invention.
Figure 6:
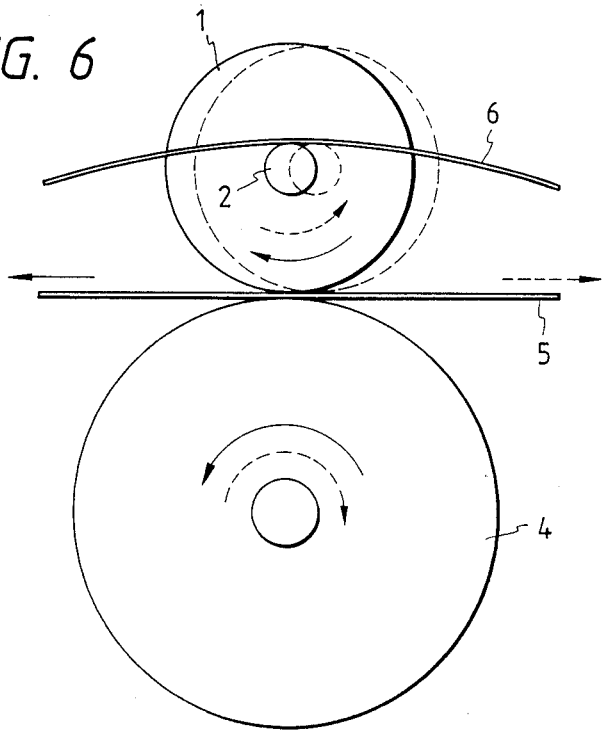
FIG. 6 is a side view of the sheet obliquely conveying apparatus embodying the present invention.
Figure 7:
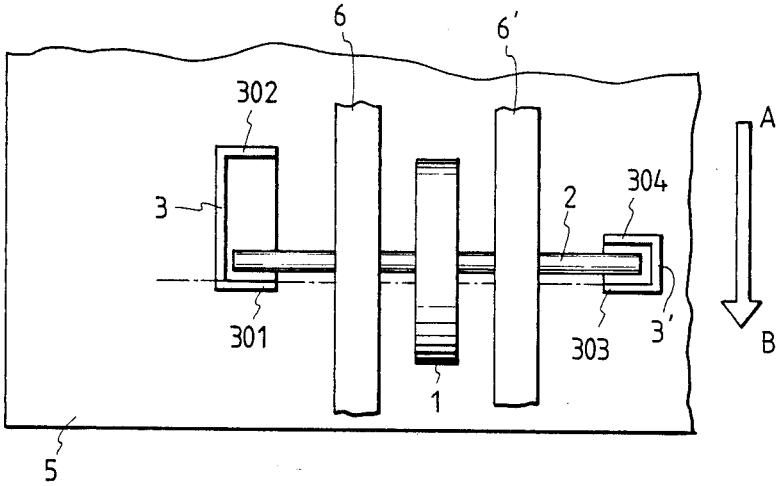
FIG. 7 is a top plan view of the sheet conveying portion according to the present invention when the roller is rotated forwardly.
Figure 8:
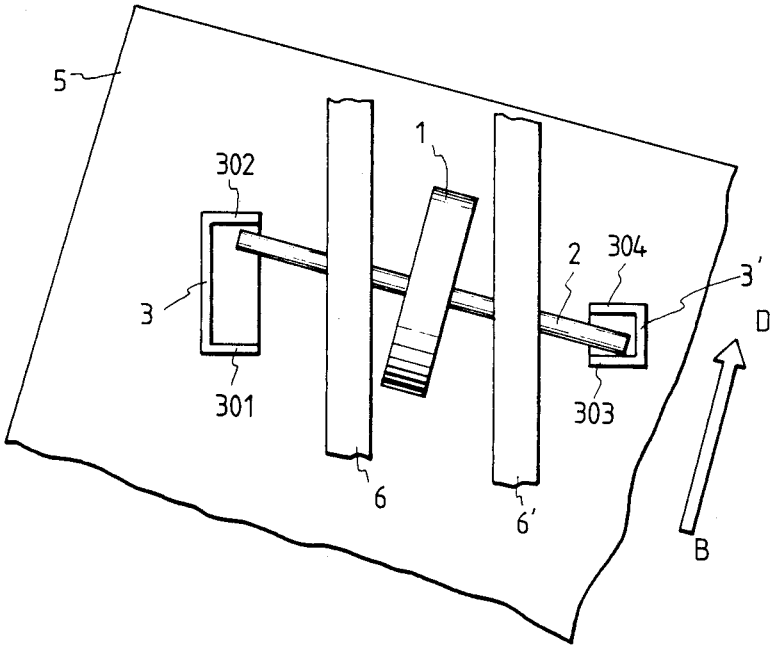
FIG. 8 is a top plan view of the sheet conveying portion according to the present invention when the roller is rotated reversely.

FIG. 5 shows the construction of a sheet conveying portion according to the present invention, FIG. 6 shows a side view thereof, and FIGS. 7 and 8 show top plan views thereof. In these figures, the reference numeral 1 designates a roller, the reference numeral 2 denotes the rotary center shaft of the roller 1, the reference numerals 3 and 3' designate bearing members receiving the shaft 2, the reference numeral 4 denotes a cylindrical drive roller which is in contact with the roller 1 and to which rotation is transmitted by a belt or the like, and the reference numerals 6 and 6' designate leaf springs urged against the shaft 2 to increase the conveying force during sheet conveyance and urge the roller 1 against the drive roller 4.

The leaf springs are long and parallel to the direction of sheet conveyance, and the opposite ends thereof are fixed at positions to which a predetermined pressure is applied. In the drawings, the leaf springs are curved so that the opposite ends thereof are lower. The leaf springs 6 and 6' each are supported at one end thereof by a support plate 10. As an alternative example, the other ends of the leaf springs may also be supported by a support plate or the like. The positional relation between the bearing members 3 and 3' is similar to that in the prior art.

The paper conveying operation is identical to that in the prior art. When sheet 5 is conveyed and the roller 1 is drawn and rotated, the leaf springs 6 and 6' are urged against the rotary shaft 2 of the roller 1, whereby the conveying force between the roller 1 and the drive roller is increased and the shaft 2 is ready to be inclined because the leaf springs are long with respect to the direction of sheet conveyance.

Figure 11:
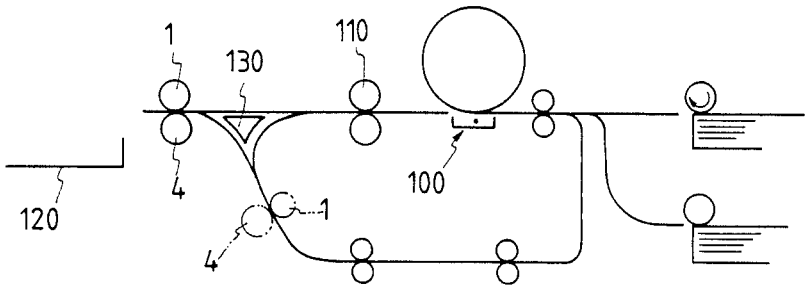
FIG. 11 is a side view schematically showing an image forming apparatus to which the present invention is applied.
Figure 12:
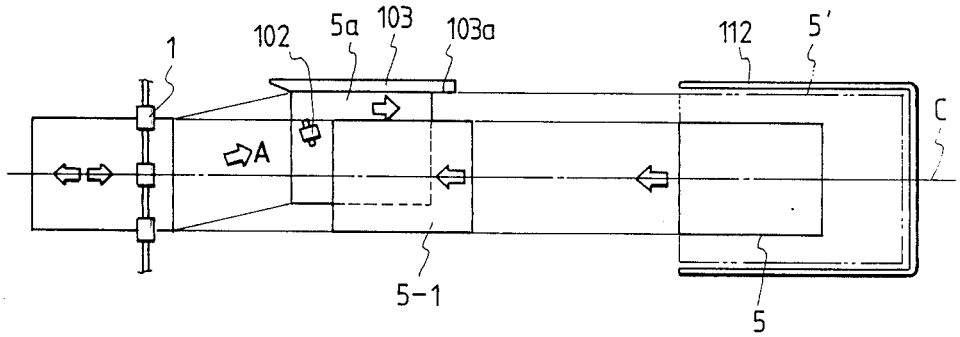
FIG. 12 is a plan view showing the flow of sheet in FIG. 11 as seen from above.

The obliquely conveying apparatus of the present invention may be used in an image forming (recording) apparatus (FIG. 11) such as a copying apparatus. When an image is to be formed on one surface or superposed on the first surface of a sheet material (a copying material or a recording material) having an image recorded on the first surface thereof by transfer means 100, it is necessary to return the sheet material to the transfer means. It is advantageous from the viewpoint of preventing any print misregistration between the first time of recording and the second time of recording to feed the sheet material at the center standard during the first time (the first surface) of recording and feed the sheet material at the side reference during the second time (the second surface or the same surface) of recording (FIG. 12).

The present invention is applied to an obliquely conveying apparatus used when the sheet material thus fed at the center reference is shifted to the side standard.

That is, an obliquely conveying roller is provided downstream of fixating means 110, and during the printing on only the first surface, the sheet material is directly discharged onto a tray 120 with the obliquely conveying roller as a discharge roller. When the second time of printing is required, the obliquely conveying roller is stopped, whereafter it is rotated reversely. By this reverse rotation, the sheet material is directed to change-over means 130 such as a flapper and goes toward a re-conveyance path. At this time, the sheet material bears against a side plate 103 which provides the one-side reference 103*a*, and is conveyed at the side reference. Of course, discretely from the discharge roller, an obliquely conveying roller may be provided downstream of the reversely rotating discharge roller in the re-conveyance path. In FIG. 12, the reference numeral 2 designates a cassette and the reference numeral 102 denotes an obliquely conveying roller.

Figure 10:
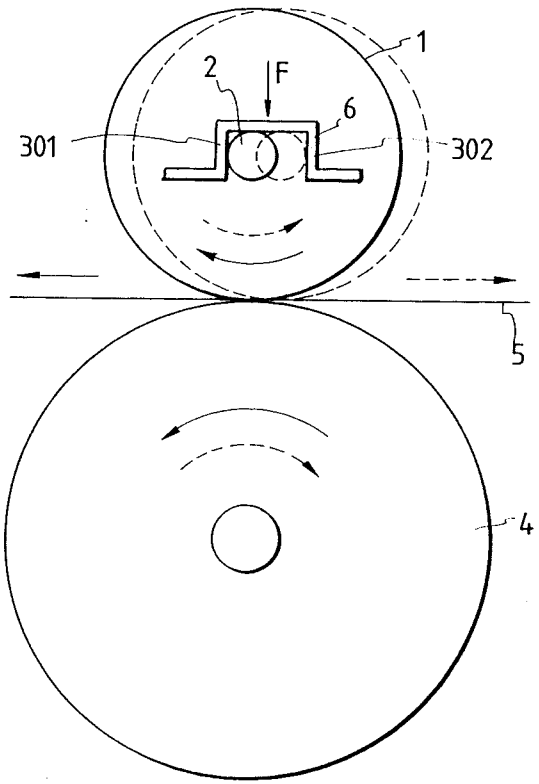
FIG. 10 is a side view of the sheet conveying portion according to said another embodiment.
Figure 9:
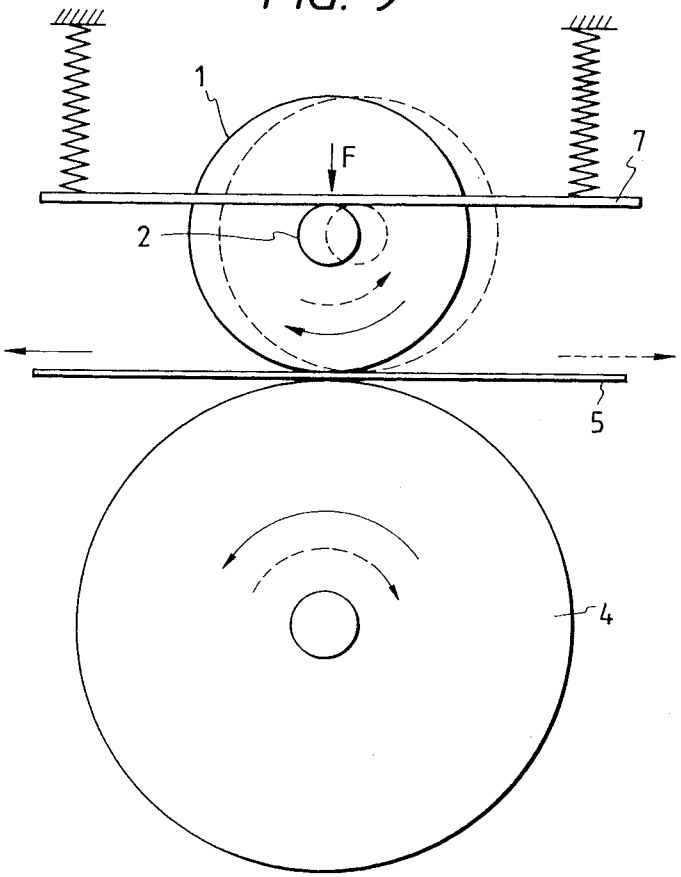
FIG. 9 is a side view of a sheet conveying portion according to another embodiment of the present invention.

The present invention is effective by the dimensions of one of the bearing members 3 and 3' holding the follower roller 1 being increased generally along the direction of sheet conveyance and by the rotary shaft 2 of the follower roller 1 being urged by a member generally parallel to the direction of sheet conveyance, and a similar effect will also be obtained if the parallel member 7 is pushed by a compression spring as shown in FIG. 9, and a load F is applied to the parallel member as shown. Also, a similar effect will also be obtained if as shown in FIG. 10, a load imparting portion and restricting ends 301 and 302 for the shaft are constructed of the same members.

A similar effect will also be obtained if the parallel member is pushed by line springs, instead of the leaf springs.

Now, the recording sheet 5 switched back by the forwardly and reversely rotated roller 1 goes toward the obliquely conveying roller 102. The obliquely conveying roller 102 is a conveying roller inclined to the left with respect to the direction of movement of the recording paper 5. A lateral register plate 103 is fixed to the left side of the obliquely conveying roller 102, and as shown in FIG. 12, the reference surface 103*a* of this lateral register plate 103 is provided in registry with the end position of a recording sheet of the greatest width used in a printer. The recording sheet 5, when nipped by the obliquely conveying roller 102, is conveyed obliquely toward the lateral register plate 103 as indicated by arrow A, and the left sheet end 5*a* is pushed against the reference surface 103*a* of the lateral register plate 103. This reference surface 103*a* is the lateral register reference when a second image of the printer is recorded, and the recording sheet 5 is adjusted in lateral registration by being pushed against the reference surface 103*a*. After adjusted in lateral registration, the recording sheet 5 is further conveyed along the reference surface 103*a* by the obliquely conveying roller 102 and is conveyed to register rollers, whereafter a second image is recorded on the recording sheet.

Description will now be made in greater detail of the difference between the lateral register reference when the first image is recorded and the lateral register reference when the second image is recorded.

The printer is effecting the sheet conveyance of the recording sheet center reference feed type and therefore, the recording sheet 5, after being fed from the cassette 112 as shown in FIG. 12, is conveyed so that the center line C (the bisecting line) with respect to a direction perpendicular to the direction of conveyance always coincides for all sizes of recording sheets until it comes to the forwardly and reversely rotated roller 10. Accordingly, the recording sheet 5 is subjected to recording at the position 5-1 of FIG. 12 when the first image is recorded thereon.

Another embodiment of the present invention will hereinafter be described with reference to the drawings.

Figure 13:
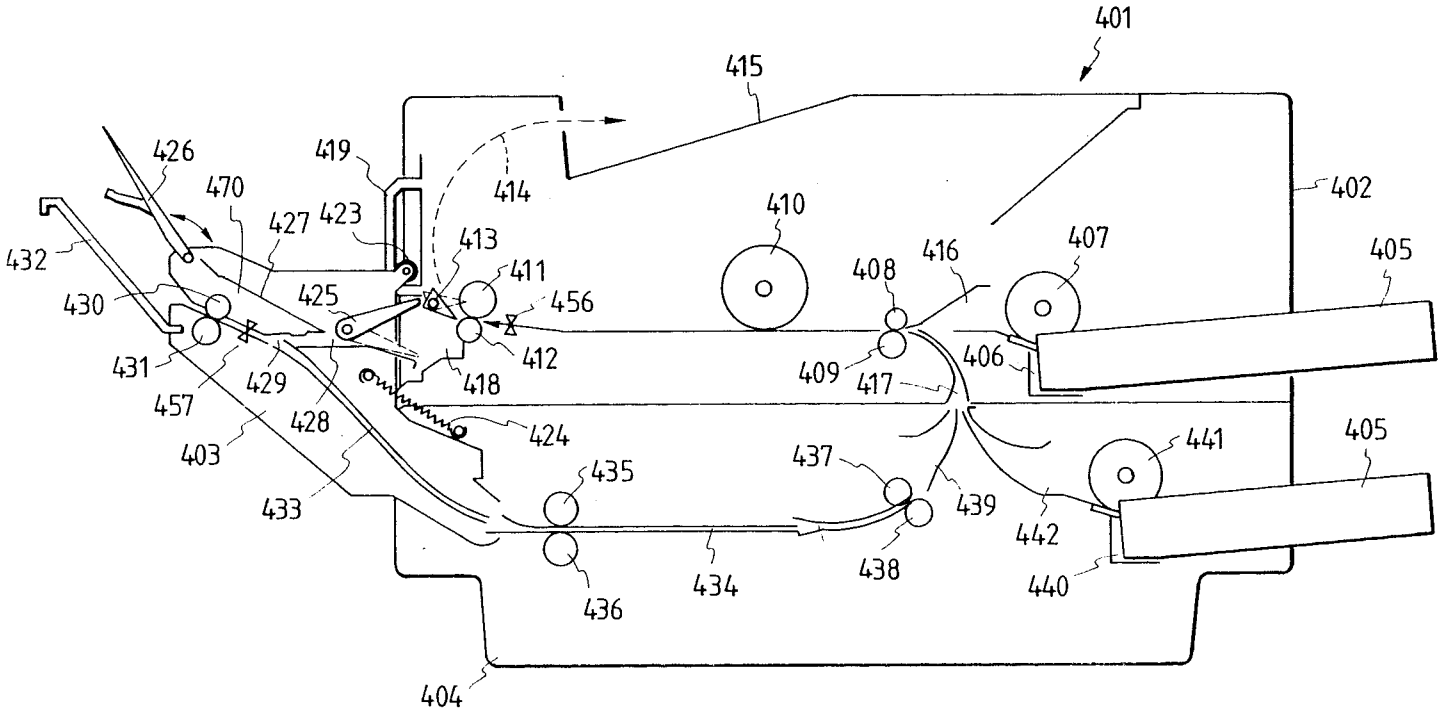
FIG. 13 is a side view of another image forming apparatus to which the present invention is applied.

An image forming apparatus, for example, a laser printer 401, shown in FIG. 13 is provided with a body 402, a conveying portion 403 and a re-feeding portion 404, and is capable of one-surface printing, both-surface printing, inversion discharging and straight discharging.

The body 402 is provided with a mounting port 406 for a sheet supply cassette 405, a sheet feed roller 407 for feeding sheets from the sheet supply cassette 405 set in the mounting port 406, sheet feed paths 416 and 417, register rollers 408 and 409 for regulating the leading end edge of the sheet supplied from the sheet feed path 416 or 417, an image forming portion 410 whose construction is not specifically shown, a sensor 456, fixating rollers 411 and 412, a change-over guide 413, an inversion path 414, an inversion sheet discharge tray 415, a communication port 418 and a conveying portion supporting arm 419.

The conveying portion 403 has one end thereof pivotably mounted on the re-feeding portion 404 by means of a shaft and the other end supported with a roller 423 engaged with the support guide 419 of the body 402, and is biased clockwise by a spring 424 mounted between the conveying portion 403 and the re-feeding portion 404.

This conveying portion 403, as shown in FIG. 13, is provided with a change-over guide 425 facing the communication port 418, a straight sheet discharge tray 427 having a pivotable rearward portion 426, a sheet feed path 428, a switch-back path 429, a sensor 457, forwardly and reversely rotatable rollers 430 and 431, an auxiliary tray 432 and a sheet feed path 433, and contains sheets in the straight sheet discharge tray 427 during straight sheet discharge, and changes the direction of conveyance of the sheet by the switch-back path 429 provided below the straight sheet discharge tray 427 during both-surface printing, thereby achieving the compactness of the apparatus.

The re-feeding portion 404 is provided with a sheet feed path 434 for conveying the sheet supplied from the sheet feed path 433, aligning rollers 435 and 436 for aligning the sheet supplied to the sheet feed path 434 with a reference position, conveying rollers 437 and 438 for conveying the sheet to the sheet feed path 434, a sheet feed path 439 for guiding the sheet conveyed by the conveying rollers 437 and 438 to the sheet feed path 417, a mounting port 440 for the sheet supply cassette 405, a sheet feed roller 441 for feeding the sheet from the sheet supply cassette 405, and a sheet feed path 442 for guiding the sheet fed by the sheet feed roller 441 to the sheet feed path 417.

Figure 14:
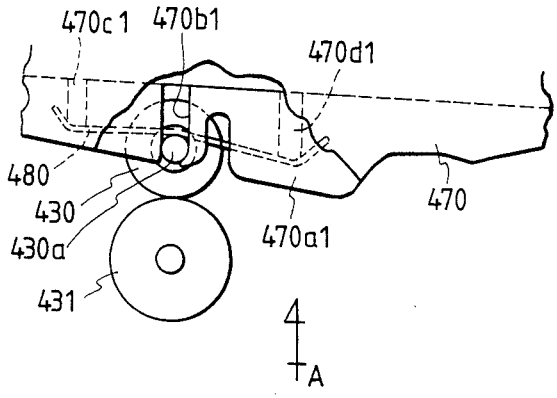
FIG. 14 is an enlarged detailed view of the essential portions of the apparatus of FIG. 13.
Figure 15:
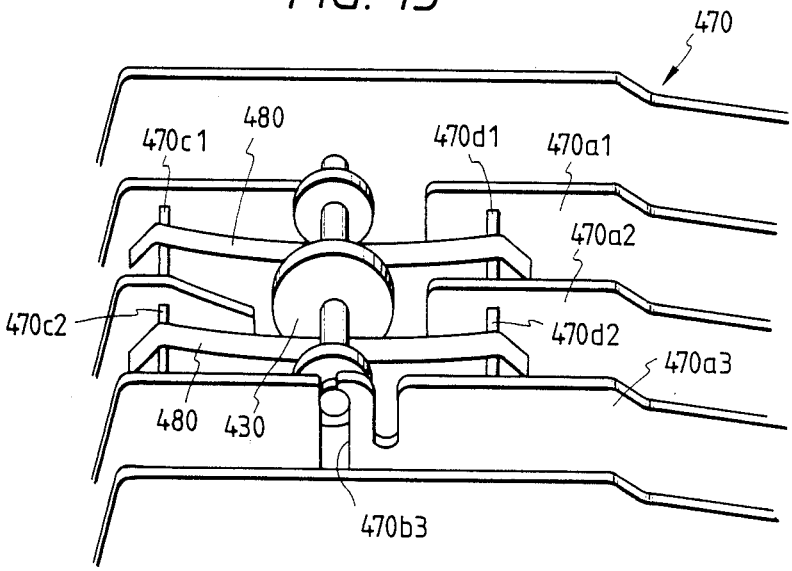
FIG. 15 is a perspective view taken along arrow A of FIG. 14.

The forwardly and reversely rotatable roller 430 is supported by a frame member 470 which constitutes the supporting surface of the tray 427. This frame member is constructed as shown in FIGS. 14 and 15, and has groove forming plates **470*a*1–470*a*3, spring receivers 470*c*1, 470*c*2, 407*d*1 and 470*d*2, and bearings 470*b*1 and 470*b*3. The bearing 470*b*3 is greater in width than the bearing 470*b*1. A leaf spring 480 is supported through the spring receivers 470*c*1, 470*c*2, 470*d*1 and 470*d*2, and pushes a roller shaft 430*a***.

Operation of the present embodiment will now be described.

(1) During Inversion Discharge

A change-over grip is rotated counter-clockwise to restrain the change-over guide 425 in its solid-line position. In this state, the change-over guide 413 is rotated through a mechanism, not shown (it is in its solid-line position).

Accordingly, the sheed fed from the sheet supply cassette 405 and printed by the image forming portion 410 is guided to the inversion path 414 by the change-over guide 413 and accommodated into the inversion sheet discharge tray 415.

(2) During Both-Surface Printing

When in the state as shown in FIG. 13, the leading end edge of the sheet having an image printed on one surface thereof by the image forming portion 410 is detected by the sensor 456, it rotates the change-over guide 413 through a mechanism, not shown. Thereby, the inversion path 414 is interupted.

Accordingly, the sheet having an image printed on one surface thereof is guided to the underside of the change-over guides 413 and 425 and supplied to the sheet feed path 428. When the leading end edge of this sheet is detected by the sensor 457, the forwardly and reversely rotatable roller 431 is driven counter-clockwise to convey the sheet toward the auxiliary tray 432.

Now, when the trailing end edge of the sheet passes the sensor 456, the solenoid is deenergized in a predetermined time and the change-over guide 413 restores the condition of FIG. 13.

When the trailing end edge of the sheet passes the sensor 457, the forwardly and reversely rotatable roller 431 is driven clockwise. Therefore, the direction of conveyance of the sheet is reversed and the sheet is supplied to the sheet feed path 433. This sheet is conveyed to the aligning reference by the aligning rollers 435 and 436.

When the trailing end edge of the switched-back sheet passes the sensor 457, the forwardly and reversely rotatable roller 431 is stopped.

The sheet aligned by the sheet feed path 434 is conveyed to the sheet feed paths 439 and 417 by the conveying rollers 437 and 438 and an image is printed on the blank (back) surface thereof by the image forming portion 410.

Thus, both surfaces of the sheet have been printed, and this sheet is supplied to the inversion path 414 by the change-over guide 413 which is now in the state of FIG. 13, and is discharged onto the inversion sheet discharge tray 415.

(3) During Straight Discharge

When printing is to be effected on sheets such as a thick sheet difficult to bend, the change-over grip is rotated clockwise. Thereby the change-over guide 425 is lowered from the state of FIG. 13 to the broken-line state. Also, the change-over guide 413 is rotated counter-clockwise by a mechanism, not shown, and assumes the state indicated by broken lines.

When printing is effected in such a state, the sheet printed by the image forming portion 410 is guided to the underside of the change-over guide 413 and the upper surface of the change-over guide 425 and is discharged onto the straight sheet discharge tray 427. The trailing end edge of this dischared sheet is supported by the communication port 418.

We claim:

1. A sheet obliquely conveying apparatus comprising:

a pair of sheet conveying means having a forwardly and reversely rotatable drive roller and a follower roller rotatable in contact with said drive roller, said follower roller being mounted on a shaft;

bearing means for rotatably supporting the shaft of said follower roller, the dimension of a first bearing portion of said bearing means which supports one end of the shaft of said follower roller being greater generally along a direction of conveyance of a sheet material than the dimension of a second bearing portion of said bearing means which supports the other end of said shaft; and resilient means generally parallel to the direction of conveyance of the sheet material for pressing the shaft of said follower roller, said resilient means comprising an elongated member elongated in the conveyance direction and pressing the shaft of the follower roller such that the shaft of the follower roller rolls on a surface of the elongated member.

2. A sheet obliquely conveying apparatus according to claim 1, wherein said elongated member comprises a leaf spring.

3. A sheet obliquely conveying apparatus according to claim 1, wherein said resilient means comprises two parallel elongated members.

4. A sheet obliquely conveying apparatus according to claim 1, wherein said pair of sheet conveying means is provided in a discharge portion of an image forming apparatus.

5. A sheet obliquely conveying apparatus according to claim 4, further comprising a sheet discharge tray provided downstream of said pair of sheet conveying means.

6. A sheet obliquely conveying apparatus according to claim 4, wherein, discretely from a sheet path having said pair of sheet conveying means, there is provided another sheet path for directing the sheet material to a sheet discharge tray.

7. A sheet obliquely conveying apparatus according to one of claim 5 or claim 6, further comprising an end surface reference, and wherein the sheet material obliquely conveyed by reverse rotation of said pair of sheet conveying means is conveyed toward the end surface reference.

8. A sheet obliquely conveying apparatus according to one of claim 5 or claim 6, wherein said image forming apparatus is capable of both-surface image formation.

9. A sheet obliquely conveying apparatus, comprising:

a pair of sheet conveying means having a forwardly and reversely rotated drive roller and a follower roller rotatable in contact with said drive roller, said follower roller being mounted on a shaft;

bearing means for rotatably supporting the shaft of said follower roller, a dimension of a bearing portion of said bearing means which supports one end of the shaft of said follower roller being greater generally along a direction of conveyance of a sheet material than a dimension of a bearing portion of said bearing means which supports the other end of said shaft; and resilient means having a pressing portion which is flat and elongated in the conveyance direction, said pressing portion pressing said follower roller shaft such that said shaft rolls on a surface of said pressing portion.

10. A sheet obliquely conveying apparatus according to one of claim 1 or claim 9, wherein said elongated member or pressing portion of said resilient means is elongated to an extent that the shaft of said follower roller engages thereagainst over a whole rocking movement thereof.

* * * * *

UNITED STATES PATENT AND TRADEMARK OFFICE

CERTIFICATE OF CORRECTION

PATENT NO. : 4,953,846

DATED : September 4, 1990

INVENTOR(S) : Azeta, et al.

It is certified that error appears in the above-identified patent and that said Letters Patent is hereby corrected as shown below:

COLUMN 1,

Line 56, change "302," to --303,--.

Signed and Sealed this

Twenty-eighth Day of April, 1992

*Attest:*

HARRY F. MANBECK, JR.

*Attesting Officer*

*Commissioner of Patents and Trademarks*